US008226209B2

(12) United States Patent
Kwon et al.

(10) Patent No.: US 8,226,209 B2
(45) Date of Patent: Jul. 24, 2012

(54) INKJET PRINTHEAD AND METHOD OF MANUFACTURING THE SAME

(75) Inventors: Myong-Jong Kwon, Suwon-Si (KR); Sung-Jun Park, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 385 days.

(21) Appl. No.: 12/570,275

(22) Filed: Sep. 30, 2009

(65) Prior Publication Data

US 2010/0079547 A1 Apr. 1, 2010

(30) Foreign Application Priority Data

Oct. 1, 2008 (KR) ..... 10-2008-0096718

(51) Int. Cl.
*B41J 2/16* (2006.01)

(52) U.S. Cl. ..... 347/47

(58) Field of Classification Search ..... 347/40, 347/42, 44, 47, 49, 54, 56, 61, 63, 64, 65, 347/20

See application file for complete search history.

(56) References Cited

U.S. PATENT DOCUMENTS

| | | | | |
|---|---|---|---|---|
| 6,409,316 | B1 * | 6/2002 | Clark et al. | 347/63 |
| 7,204,574 | B2 * | 4/2007 | Bertelsen et al. | 347/20 |
| 2008/0122895 | A1 * | 5/2008 | Hart et al. | 347/47 |
| 2008/0303869 | A1 * | 12/2008 | Park et al. | 347/54 |

FOREIGN PATENT DOCUMENTS

| | | |
|---|---|---|
| JP | 04-094942 | 3/1992 |
| KR | 10-1999-0063070 | 7/1999 |

OTHER PUBLICATIONS

English language abstract of JP 04-094942, published Mar. 27, 1992.
English language abstract of KR 10-1999-0063070, published Jul. 26, 1999.

* cited by examiner

*Primary Examiner* — Kristal Feggins
(74) *Attorney, Agent, or Firm* — Staas & Halsey LLP

(57) ABSTRACT

Provided are an inkjet printhead and a method of manufacturing the same. The inkjet printhead may include a substrate having an ink feed passage, a chamber layer formed on the substrate and a plurality of ink chambers fillable with ink supplied from the ink feed hole. The printhead may also include a nozzle layer formed on the chamber layer, which includes a plurality of nozzles through which the ink is ejected and a glue layer interposed between the substrate and the chamber layer. The glue layer may include a cross-linked photoresist composition including photoresist.

10 Claims, 7 Drawing Sheets

INKJET PRINTHEAD AND METHOD OF MANUFACTURING THE SAME

CROSS-REFERENCE TO RELATED PATENT APPLICATION

This application claims the benefit of Korean Patent Application No. 10-2008-0096718, filed on Oct. 1, 2008, in the Korean Intellectual Property Office, the disclosure of which is incorporated by reference herein in its entirety.

TECHNICAL FIELD

This disclosure relates to inkjet printing. In particular, it is a thermal inkjet printhead and a method of manufacturing the same.

BACKGROUND

Inkjet printheads are devices for printing an image on a printing medium by ejecting droplets of ink onto a desired region of the printing medium. Inkjet printheads can be classified into two different types depending on the mechanism of ejecting ink droplets: (1) a thermal inkjet printhead, in which ink is heated to form ink bubbles and the expansive force of the bubbles causes ink droplets to be ejected; and (2) a piezoelectric inkjet printhead, in which a piezoelectric crystal is deformed and the pressure due to the deformation causes ink droplets to be ejected.

The mechanism of ejecting ink droplets of the thermal inkjet printhead will be described in more detail. When current in the form of pulse wave is supplied to a heater formed of a heating resistor, ink surrounding the heater is instantly heated to about 300° C. due to the heat generated by the heater. Accordingly, ink boils to generate bubbles, and the bubbles expand to apply pressure to ink filled in an ink chamber. Thus, ink in the vicinity of a nozzle is ejected through the nozzle in the form of droplets.

The thermal inkjet printhead can have a structure in which a chamber layer and a nozzle layer are sequentially stacked on a substrate on which a plurality of material layers are formed. In this regard, a plurality of ink chambers, which are filled with ink to be ejected, are formed in the chamber layer, and a plurality of nozzles through which ink is ejected are formed in the nozzle layer. Also, the substrate may have an ink feed hole for supplying ink to the ink chambers.

SUMMARY

In one embodiment, the disclosure is an inkjet printhead. The printhead comprises at least one substrate having at least one ink feed passage. At least one ink chamber is in communication with the ink feed passage. The ink chamber is configured to house ink from the ink feed hole. At least one nozzle layer is disposed above the chamber layer. The nozzle layer comprises at least one nozzle in communication with the ink chamber. The nozzle is configured to eject ink. At least one glue layer may be interposed between the substrate and the chamber layer. The glue layer comprises a cross-linked photoresist composition comprising photoresist.

In another embodiment, the disclosure is a method of manufacturing an inkjet printhead. The method comprises: forming at least one glue layer by cross-linking a photoresist composition comprising photoresist; providing the glue layer on a substrate; forming at least one chamber layer above the glue layer; forming, on the chamber layer, at least one nozzle layer comprising at least one nozzle; forming at least one ink feed passage in the substrate and forming at least one ink chamber and at least one restrictor in the chamber layer. The ink chamber and restrictor are in communication with the ink feed passage and the nozzle.

BRIEF DESCRIPTION OF THE DRAWINGS

The above and other features and advantages of the disclosure will become more apparent by describing in detail exemplary embodiments thereof with reference to the attached drawings in which:

FIG. 3 is a cross-sectional view of a substrate of an embodiment of an inkjet printhead having various layers thereon;

FIG. 4 is a is a cross-sectional view of the substrate shown in FIG. 3 with a chamber material layer;

FIG. 5 is a cross-sectional view of the substrate shown in FIG. 4 after exposure and PEB processes have been performed on the chamber material layer;

FIG. 6 is a cross-sectional view of the substrate shown in FIG. 5 with a sacrificial layer;

FIG. 7 is a cross-sectional view of the substrate shown in FIG. 6 after the sacrificial layer and chamber layer have undergone a planarization process;

FIG. 8 is a cross-sectional view of the substrate shown in FIG. 7 with a nozzle material layer;

FIG. 9 is a cross-sectional view of the substrate shown in FIG. 8 after the nozzle material layer has undergone an exposure process;

FIG. 10 is a cross-sectional view of the substrate shown in FIG. 9 with a nozzle layer formed over the sacrificial layer;

FIG. 11 is a cross-sectional view of the substrate shown in FIG. 10 with an ink feed passage; and FIG. 12 is a cross-sectional view of an inkjet printhead according to an embodiment of the disclosure.

DETAILED DESCRIPTION

Figure 1:
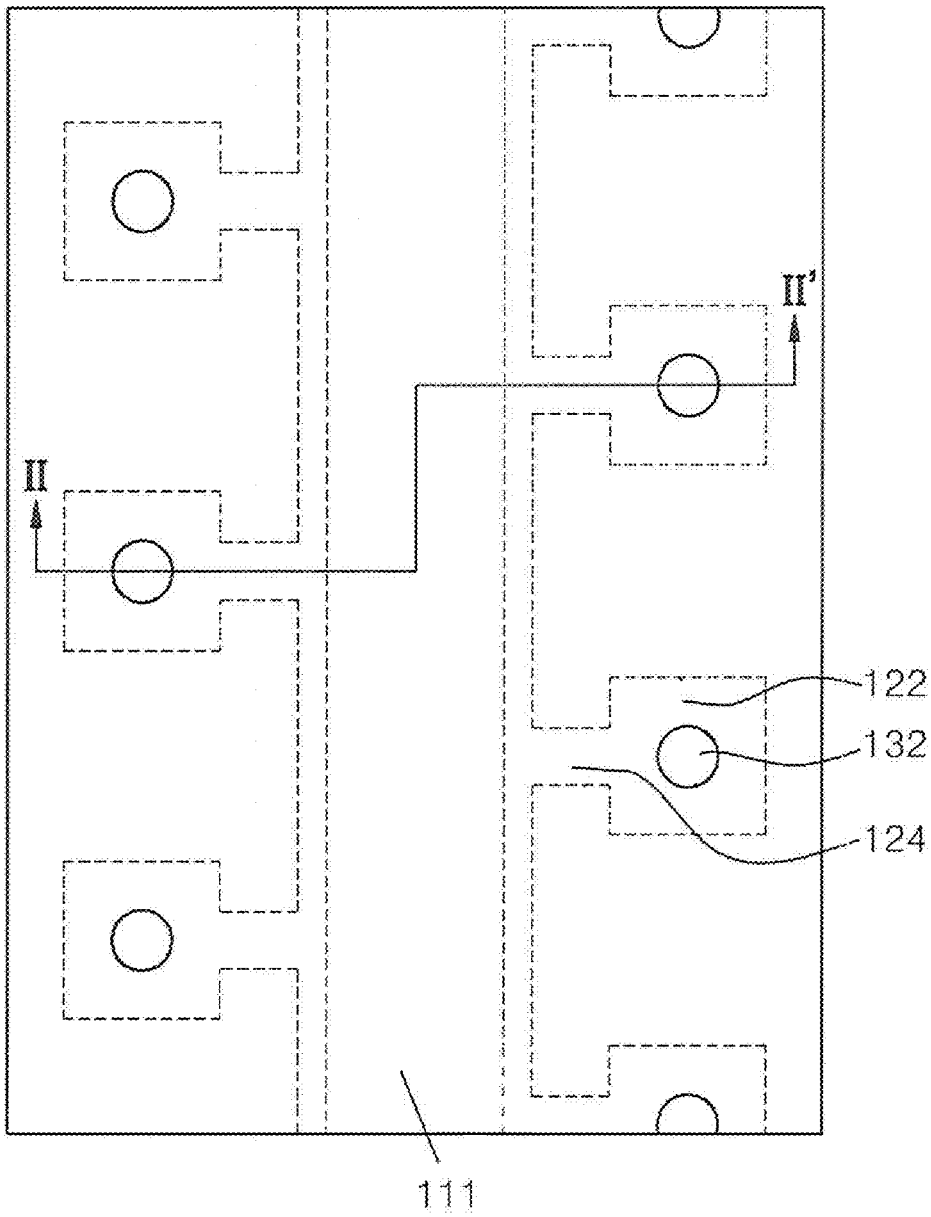
FIG. 1 is a schematic plan view of an inkjet printhead according to an embodiment of the disclosure.

The disclosure will now be described more fully with reference to the accompanying drawings, in which exemplary embodiments are shown. In the drawings, like reference numerals denote like elements, and the size or the thickness of each element may be exaggerated for clarity. It will also be understood that when a layer is referred to as being "on" or above another layer or substrate, it can be directly on top of; i.e., in contact with the other layer or substrate, or intervening layers or spaces may also be present.

Figure 2:
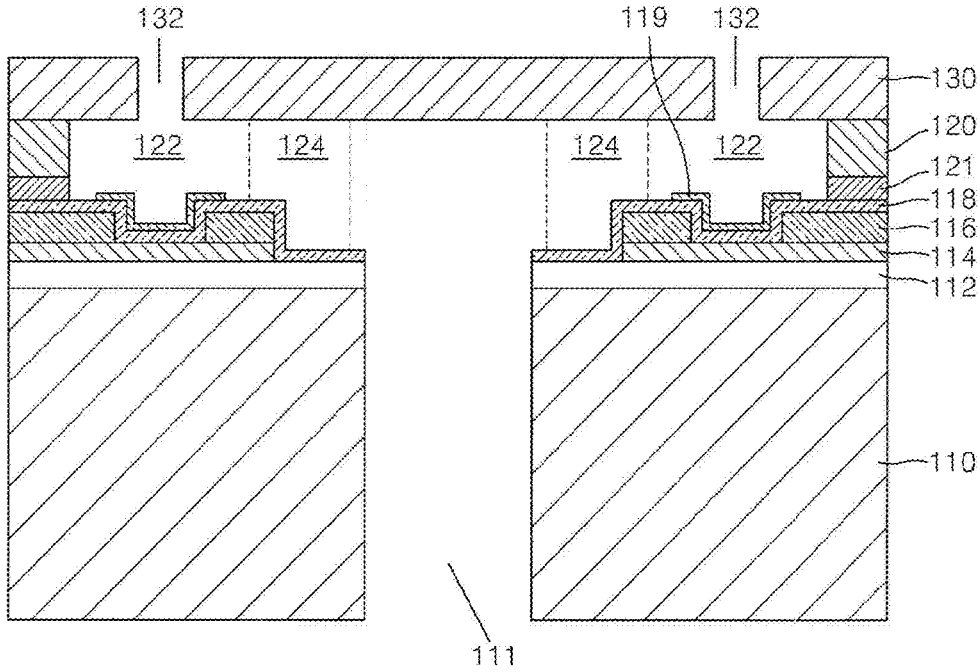
FIG. 2 is a cross-sectional view taken along line II-II' of FIG. 1.

FIG. 1 is a schematic plan view of a thermal inkjet printhead according to an embodiment of the disclosure. FIG. 2 is a cross-sectional view taken along line II-II' of FIG. 1.

Referring to FIGS. 1 and 2, a chamber layer 120 and a nozzle layer 130 are sequentially formed on a substrate 110 on which various material layers are formed. The substrate 110 may be formed of silicon. An ink feed hole or passage 111 for supplying ink is formed through the substrate 110.

An insulating layer 112 may be formed on the substrate 110 for heat and electrical insulation between the substrate 110 and heaters 114 that will be described later. The insulating layer 112 may be formed of a silicon oxide. As shown in FIG. 2, insulating layer 112 may be in contact with substrate 110 and heater 114. The heater 114 for generating ink bubbles by heating ink filled in an ink chamber 122 may be formed on the insulating layer 112. In this regard, the heater may be formed below the ink chamber 122. The heater 114 may be formed of a heating resistor material such as a tantalum-aluminum alloy, a tantalum nitride, a titanium nitride, and a tungsten silicide, but is not limited thereto. As shown in FIG. 2, heater 114 may be in contact with insulating layer 112 and electrode 116.

The electrode 116 is formed on the top surface of the heater 114. The electrode 116 may be comprised of a material having excellent electrical conductivity in order to supply current to the heater 114. The electrode 116 may be formed of Al, an Al alloy, Au, Ag, or the like, but is not limited thereto. As shown in FIG. 2, electrode 116 may be in contact with heater 114 and passivation layer 118.

The passivation layer 118 may be formed on or above the heater 114 and the electrode 116. In this regard, the passivation layer 118 prevents oxidization and corrosion of the heater 114 and the electrode 116 caused by ink. The passivation layer may be comprised of a silicon nitride or a silicon oxide. An anti-cavitation layer 119 may further be formed on the passivation layer 118. The anti-cavitation layer 119 to protects the heater 114 from a cavitation force generated when bubbles are extinguished, and may be formed of tantalum (Ta).

As shown in FIG. 2, passivation layer 118 may be in contact with electrode 116 and glue 121. The glue layer 121 may be formed on the passivation layer 118 in order to increase an adhesion force between the chamber layer 120 and the passivation layer 118.

The glue layer 121 is used to bond the substrate 110, on which a plurality of material layers such as the insulating layer 112, the heater 114, the electrode 116, the passivation layer 118, and the chamber layer 120 are formed. According to the embodiment shown in FIG. 2, the glue layer 121 may be interposed between the passivation layer 118 and the chamber layer 120. The glue layer 121 may be formed by coating a photoresist composition including photoresist, and patterning the photoresist composition using photolithography.

Any material that is cured by a photolithography process so as to have adhesive force may be used as the photoresist contained in the photoresist composition used to form the glue layer 121. For example, a phenol-based resin, an acryl-based resin, or a mixture thereof may be used as the photoresist.

The phenol-based resin, as photoresist, may be alkali-soluble and may be prepared by the reaction between a phenol-based compound and an aldehyde-based compound or a ketone-based compound in the presence of an acidic catalyst.

The phenol-based compound may be phenol, o-cresol, m-cresol, p-cresol, 2,3-dimethylphenol, 3,4-dimethylphenol, 3,5-dimethylphenol, 2,4-dimethylphenol, 2,6-dimethylphenol, 2,3,6-trimethylphenol, 2-t-butylphenol, 3-t-butylphenol, 4-t-butylphenol, 2-methylresorcinol, 4-methylresorcinol, 5-methylresorcinol, 4-t-butylcatechol, 2-methoxyphenol, 3-methoxyphenol, 2-propylphenol, 3-propylphenol, 4-propylphenol, 2-isoprophenol, 2-methoxy-5-methylphenol, 2-t-butyl-5-methylphenol, thymol, isothymol, or the like. The compounds may be used alone or in a combination. A combination of m-cresol and p-cresol may be used in consideration of controlling photoresist sensitivity. In this regard, the weight ratio of m-cresol to p-cresol may be about 80:20 to about 20:80, and preferably, about 70:30 to about 50:50.

The aldehyde-based compound may be formaldehyde, formalin, p-formaldehyde, trioxane, acetaldehyde, propylaldehyde, benzaldehyde, phenylacetaldehyde, alpha-phenylpropylaldehyde, beta-phenylpropylaldehyde, o-hydroxybenzaldehyde, m-hydroxybenzaldehyde, p-hydroxybenzaldehyde, o-chlorobenzaldehyde, m-chlorobenzaldehyde, p-chlorobenzaldehyde, o-methylbenzaldehyde, m-methylbenzaldehyde, p-methylbenzaldehyde, p-ethylbenzaldehyde, p-n-butylbenzaldehyde, terephthalic acid aldehyde, or the like. The compounds may be used alone or in a combination.

The ketone-based compound may be acetone, methyl ethyl ketone, diethyl ketone, diphenyl ketone, or the like. The compounds may be used alone or in a combination.

The acryl-based resin, as a photoresist, is alkali-soluble, and may be glycidyl acrylate, methyl(metha)acrylate, ethyl (metha)acrylate, methacrylic acid, styrene, benzylacrylate, acrylic acid, or the like.

The acryl-based resin may be glycidyl acrylate, and preferably, glycidyl acrylate represented by the formula below:

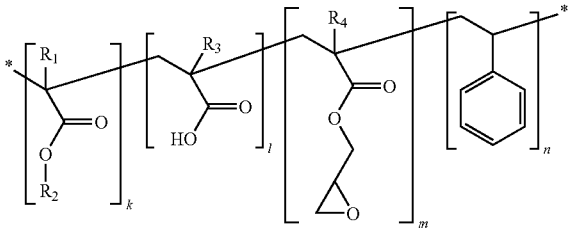

$R_1$, $R_3$ and $R_4$ are each independently a methyl group or a hydrogen atom, $R_2$ is a phenyl group or a benzyl group, and k, l, m and n are each independently from about 0.01 to about 0.99, wherein the sum of k, l, m and n is 1.

The photoresist composition used to form the glue layer 121 may further include a cross-linking agent, a photoacid generator, and a solvent in addition to the photoresist. The photoresist composition may include about 1 to about 20 parts by weight of the cross-linking agent, about 0.5 to about 10 parts by weight of the photoacid generator, and about 10 to about 200 parts by weight of the solvent, based on about 1 to about 70 parts by weight of the photoresist.

The cross-linking agent contained in the photoresist composition forms a cross-linked photoresist by the photolithography process. The amount of the cross-linking agent may be about 1 to about 20 parts by weight based on about 1 to about 70 parts by weight of the photoresist. The cross-linking agent may be a condensate of urea and formaldehyde, a condensate of melamine and formaldehyde, or a compound derived from alcohol such as methylol urea alkyl ether or methylol melamine alkyl ether.

In particular, the condensate of urea and formaldehyde may be monomethylol urea, dimethylol urea, or the like. The condensate of melamine and formaldehyde may be hexamethylol melamine. A compound prepared by partial condensation between melamine and formaldehyde may also be used.

In addition, the methylol urea alkyl ether may be prepared by the reaction of the condensate of urea and formaldehyde, a partial or entire methylol group, and an alcohol, and examples of the methylol urea alkyl ether are mono methyl urea methyl ether and dimethyl urea methyl ether. The methylol melamine alkylether may be prepared by the reaction of the condensate of melamine and formaldehyde, a partial or entire methylol group, and an alcohol, and examples of the methylol melamine alkyl ether are hexamethylol melamine hexamethyl ether and hexamethylol melamine hexabutyl ether. In addition, a compound in which a hydrogen atom of an amino group of melamine is substituted with a hydroxy methyl group or a methoxy methyl, or a compound in which a hydrogen atom of an amino group of melamine is substituted with a butoxy methyl group or a methoxy methyl group may also be used. In particular, methylol melamine alkylether may be used.

The amount of the photoacid generator contained in the photoresist composition may be about 0.5 to about 10 parts by weight based on about 1 to about 70 parts by weight of the photoresist.

Any compound that can generate acid by light may be used for the photoacid generator. Preferably, an ionic photoacid generator such as a sulfonium salt and an iodonium salt, sulfonyldiazomethane, N-sulfonyloxyimide, benzoinsulfonate, nitrobenzylsulfonate, sulfone, glyoxime, triazine, or the like, may be used.

In particular, the sulfonium salt is a salt consisting of a sulfonium cation and a sulfonate (anion of sulfonic acid). The sulfonium cation may be triphenolsulfonium, (4-tert-butoxyphenyl)diphenylsulfonium, bis(4-tert-butoxyphenyl)phenylsulfonium, 4-methylphenyldiphenylsulfonium, tris(4-methylphenylsulfonium), 4-tert-butylphenyldiphenylsulfonium, tris(4-tert-butylphenyl)sulfonium, tris(4-tert-butoxyphenyl)sulfonium, (3-tert-butoxyphenyl)diphenylsulfonium, bis(3-tert-butoxyphenyl)phenylsulfonium, tris(3-tert-butoxyphenyl)sulfonium, (3,4-ditert-butoxyphenyl)diphenylsulfonium, bis(3,4-ditert-butoxyphenyl)phenylsulfonium, tris(3,4-ditert-butoxyphenyl)sulfonium, diphenyl(4-thiophenoxyphenyl)sulfonium, (4-tert-butoxycarbonylmethyloxyphenyl)diphenylsulfonium, tris(4-tert-butoxycarbonylmethyloxyphenyl)sulfonium, (4-tert-butoxyphenyl)bis(4-dimethylaminophenyl)sulfonium, tris(4-dimethylaminophenyl)sulfonium, 2-naphthyldiphenylsulfonium, dimethyl-2-naphthylsulfonium, 4-hydroxyphenyldimethylsulfonium, 4-methoxyphenyldimethylsulfonium, trimethylsulfonium, diphenylmethylsulfonium, methyl-2-oxopropylphenylsulfonium, 2-oxocyclohexylcyclohexylmethylsulfonium, trinaphthylsulfonium, tribenzylsulfonium, or the like. The sulfonate may be trifluoromethanesulfonate, nonafluorobutanesulfonate, heptadecafluorooctanesulfonate, 2,2,2-trifluoroethanesulfonate, pentafluorobenzenesulfonate, 4-trifluoromethylbenzenesulfonate, 4-fluorobenzenesulfonate, toluenesulfonate, benzenesulfonate, naphthalenesulfonate, camphosulfonate, octanesulfonate, dodecylbenzenesulfonate, butanesulfonate, methanesulfonate, or the like.

The iodonium salt is a salt consisting of an iodonium cation with sulfonate (anion of sulfonic acid). The iodonium cation may be diphenyliodonium, bis(4-tert-butylphenyl)iodonium, 4-tert-butoxyphenylphenyliodonium, 4-methoxyphenylphenyliodonium, or the like. The sulfonate may be trifluoromethanesulfonate, nonafluorobutasulfonate, heptadecafluorooctanesulfonate, 2,2,2-trifluoroethanesulfonate, pentafluorobenzenesulfonate, 4-trifluoromethylbenzenesulfonate, 4-fluorobenzenesulfonate, toluenesulfonate benzenesulfonate, naphthalenesulfonate, camphosulfonate, octanesulfonate, dodecylbenzenesulfonate, butanesulfonate, methanesulfonate, or the like.

The sulfonyldiazomethane-based photoacid generator may be bissulfonyldiazomethane and sulfonylcarbonyldiazomethane such as bis(ethylsulfonyl)diazomethane, bis(1-methylpropylsulfonyl)diazomethane, bis(2-methylpropylsulfonyl)diazomethane, bis(1,1-dimethylethylsulfonyl)diazomethane, bis(cyclohexylsulfonyl)diazomethane, bis(perfluoroisopropylsulfonyl)diazomethane, bis(phenylsulfonyl)diazomethane, bis(4-methylphenylsulfonyl)diazomethane, bis(2,4-dimethylphenylsulfonyl)diazomethane, bis(2-naphthylsulfonyl)diazomethane, 4-methylphenylsulfonylbenzoyldiazomethane, tert-butylcarbonyl-4-methylphenylsulfonyldiazomethane, 2-naphthylsulfonylbenzoyldiazomethane, 4-methylphenylsulfonyl-2-naphthoyldiazomethane, methylsulfonylbenzoyldiazomethane, and tert-butoxycarbonyl-4-methylphenylsulfonyldiazomethane.

The N-sulfonyloxyimide-based photoacid generator may be an imide such as succinic acid imide, naphthalenedicarboxylic acid imide, phthalic acid imide, cyclohexyldicarboxylic acid imide, 5-norbornene-2,3-dicarboxylic acid imide, and 7-oxabicyclo[2,2,1]-5-heptene-2,3-dicarboxylic acid imide, trifluoromethanesulfonate, nonafluorobutanesulfonate, heptadecafluorooctanesulfonate, 2,2,2-trifluoroethanesulfonate, pentafluorobenzenesulfonate, 4-trifluoromethylbenzenesulfonate, 4-fluorobenzenesulfonate, toluenesulfonate, benzenesulfonate, naphthalenesulfonate, camphosulfonate, octanesulfonate, dodecylbenzenesulfonate, butanesulfonate, methanesulfonate, or the like.

The benzoinsulfonate-based photoacid generator may be benzoin tosylate, benzoin mesylate, benzoin butanesulfonate, or the like.

The nitrobenzylsulfonate-based photoacid generator may be 2,4-dinitrobenzylsulfonate, 2-nitrobenzylsulfonate, 2,6-dinitrobenzylsulfonate, or the like. The sulfonate may be trifluoromethanesulfonate, nonafluorobutanesulfonate, heptadecafluorooctanesulfonate, 2,2,2-trifluoroethanesulfonate, pentafluorobenzenesulfonate, 4-trifluoromethylbenzenesulfonate, 4-fluorobenzenesulfonate, toluenesulfonate, benzenesulfonate, naphthalenesulfonate, camphosulfonate, octanesulfonate, dodecylbenzenesulfonate, butanesulfonate, methanesulfonate, or the like. Furthermore, a compound in which a nitro group of a benzyl moiety is substituted with a trifluoromethyl group may also be used.

The sulfone-based photoacid generator may be bis(phenylsulfonyl)methane, bis(4-methylphenylsulfonyl)methane, bis(2-naphthylsulfonyl)methane, 2,2-bis(phenylsulfonyl)propane, 2,2-bis(4-methylphenylsulfonyl)propane, 2,2-bis(2-naphthylsulfonyl)propane, 2-methyl-2-(p-toluenesulfonyl)propionenone, 2-(cyclohexylcarbonyl)-2-(p-toluenesulfonyl)propane, 2,4-dimethyl-2-(p-toluenesulfonyl)pentane-3-one, or the like.

The glyoxime-based photoacid generator may be bis-o-(p-toluenesulfonyl)-α-dimethylglyoxime, bis-o-(p-toluenesulfonyl)-α-dicyclohexylglyoxime, bis-o-(p-toluenesulfonyl)-2,3-pentanedioneglyoxime, bis-o-(p-toluenesulfonyl)-2-methyl-3,4-pentanedioneglyoxime, bis-o-(n-butanesulfonyl)-α-dimethylglyoxime, bis-o-(n-butanesulfonyl)-α-dicyclohexylglyoxime, bis-o-(n-butanesulfonyl)-2,3-pentanedioneglyoxime, bis-o-(n-butanesulfonyl)-2-methyl-3,4-pentanedioneglyoxime, bis-o-(methanesulfonyl)-α-dimethylglyoxime, bis-o-(trifluoromethanesulfonyl)-α-dimethylglyoxime, bis-o-(1,1,1-trifluoroethanesulfonyl)-α-dimethylglyoxime, bis-o-(tert-butanesulfonyl)-α-dimethylglyoxime, bis-o-(perfluorooctanesulfonyl)-α-dimethylglyoxime, bis-o-(cyclohexylsulfonyl)-α-dimethylglyoxime, bis-o-(benzenesulfonyl)-α-dimethylglyoxime, his-o-(p-fluorobenzenesulfonyl)-α-dimethylglyoxime, bis-o-(p-tert-butylbenzenesulfonyl)-α-dimethylglyoxime, bis-o-(xylenesulfonyl)-α-dimethylglyoxime, bis-o-(camphosulfonyl)-α-dimethylglyoxime, or the like.

The triazine-based photoacid generator may be PDM-triazine, WS-triazine, PDM-triazine, dimethoxy-triazine, MP-triazine, TFE-triazine, TME-triazine (manufactured by Samwha Chemical Co., Ltd.), or the like.

The solvent contained in the photoresist composition may be propylene glycol methyl ether acetate (PGMEA) and 2,2,4-triemthyl-1,3-penthanediolmonoisobutylate (TMPMB), or the like. The amount of the solvent may be about 10 to about 200 parts by weight based on about 1 to about 70 parts by weight of the photoresist. When the amount of the solvent is less than about 10 parts by weight, coating uniformity may be decreased. On the other hand, when the amount of the solvent is greater than about 200 parts by weight, workability may not be sufficient.

The photoresist composition is coated on the substrate 110 and patterned by the photolithography process to form the glue layer 121.

A chamber layer 120 formed of a first negative photoresist composition is formed on the glue layer 121. The chamber layer 120 has a plurality of ink chambers 122 fillable with ink supplied from the ink feed hole 111 that is, chambers are in communication with feed hole 111. The chamber layer 120 may further include a plurality of restrictors 124 which connect the ink feed hole 111 and the ink chambers 122. The chamber layer 120 may be formed by forming a chamber material layer (120' of FIG. 4) including the first negative photoresist composition on the glue layer 121 and patterning the chamber material layer 120' using a photolithography process.

The first negative photoresist composition may be formed of a negative type photosensitive polymer. In this regard, since unexposed regions of the first negative photoresist composition are removed by a developing solution, a plurality of ink chambers 122 and restrictors 124 may be formed. Exposed regions of the first negative photoresist composition have a cross-linked structure due to a post exposure bake (PEB) process for forming the chamber layer 120.

A nozzle layer 130 formed of a second negative photoresist composition is formed on the chamber layer 120. The nozzle layer 130 has a plurality of nozzles 132 through which ink is ejected. The nozzles are in communication with chambers 122. The nozzle layer 130 may be formed by forming a nozzle material layer (130' of FIG. 8) including the second negative photoresist composition on the chamber material layer 120 and patterning the nozzle material layer 130' using a photolithography process.

The second negative photoresist composition may be formed of a negative type photosensitive polymer. In this regard, since unexposed regions of the second negative photoresist composition are removed by a developing solution, a plurality of nozzles 132 may be formed. Exposed regions of the second negative photoresist composition have a cross-linked structure due to a PEB process for forming the nozzle layer 130. The formation of the chamber layer 120 and the nozzle layer 130 will be described later in more detail.

The first and second negative photoresist compositions used herein may include a prepolymer having a phenol novolac resin backbone, a bisphenol-A backbone, a bisphenol-F backbone, or an alicyclic backbone, and a glycidyl ether functional group, a ring-opened glycidyl ether functional group, or an oxytein functional group in a monomer repeating unit; a cationic photoinitiator; a solvent and a plasticizer. In particular, the first and second negative photoresist compositions may be the same or different but preferably, are the same.

The prepolymer contained in the first and second negative photoresist compositions may form a cross-linked polymer by being exposed to actinic rays. The prepolymer may be formed from a backbone monomer selected from the group consisting of phenol, o-cresol, p-cresol, bisphenol-A, an alicyclic compound, and a mixture thereof. The prepolymer including the glycidyl ether functional group may include a bifunctional glycidyl ether group and a multifunctional glycidyl ether group, but is not limited thereto.

The prepolymer including the bifunctional glycidyl ether group may be a compound represented by Formula 1 below.

Formula 1

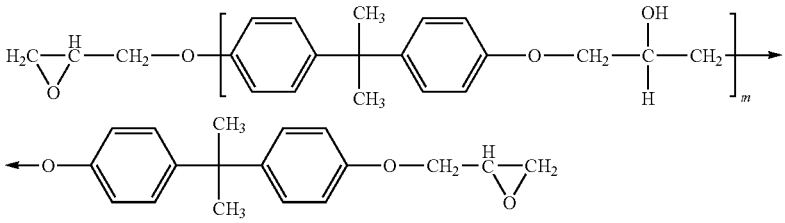

where m is an integer from 1 to 20.

The prepolymer including the bifunctional glycidyl ether group may form a film having a low cross-linking density.

The prepolymer including the bifunctional glycidyl ether group may be EPON 828, EPON 1004, EPON 1001F, EPON 1010, or the like, manufactured by Shell Chemicals Co. Ltd., DER-332, DER-331, DER-164, or the like, manufactured by Dow Chemical Company, and ERL-4201, ERL-4289, or the like, manufactured by Union Carbide Corporation, but is not limited thereto.

In addition, the prepolymer including the multifunctional glycidyl ether group may be EPON SU-8, EPON DPS-164, or the like, manufactured by Shell Chemicals Co. Ltd., DEN-431, DEN-439, or the like, manufactured by Dow Chemical Company, and EHPE-3150, or the like, manufactured by Daicel Chemical Industries, Ltd., but is not limited thereto.

The prepolymer including a phenol novolac resin backbone and a glycidyl ether functional group in a monomer repeating unit may be a compound represented by Formula 2 below.

Formula 2

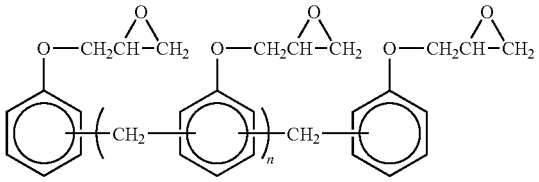

wherein n is an integer from about 1 to about 20, and preferably, from 1 to 10.

The prepolymer including a phenol novolac resin backbone and a glycidyl ether functional group in a monomer repeating unit may also be compounds represented by Formulas 3 and 4 in which o-cresol or p-cresol is used instead of phenol.

Formula 3

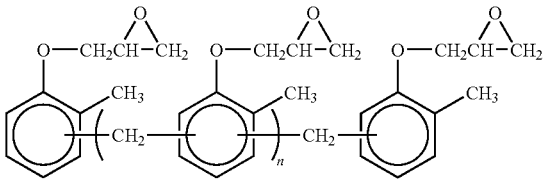

Formula 4

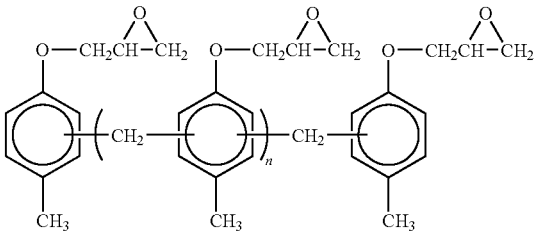

wherein n is an integer from about 1 to about 20, and preferably, from 1 to 10.

The prepolymer including a bisphenol-A backbone and a glycidyl ether functional group in a monomer repeating unit may be compounds represented by Formulas 5 and 6.

Formula 5

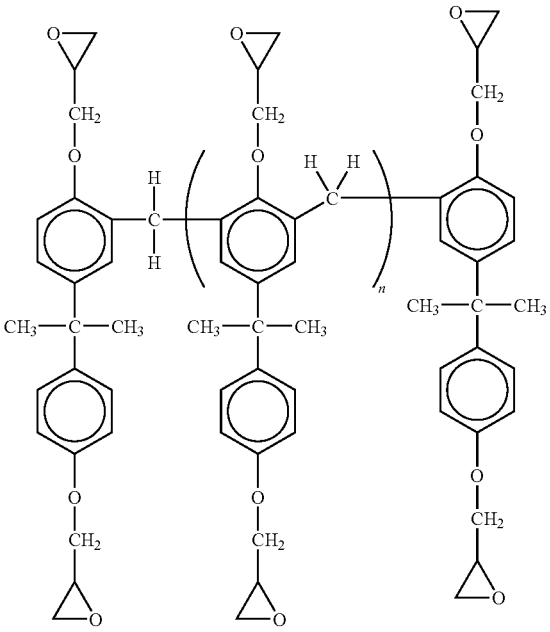

-continued

Formula 6

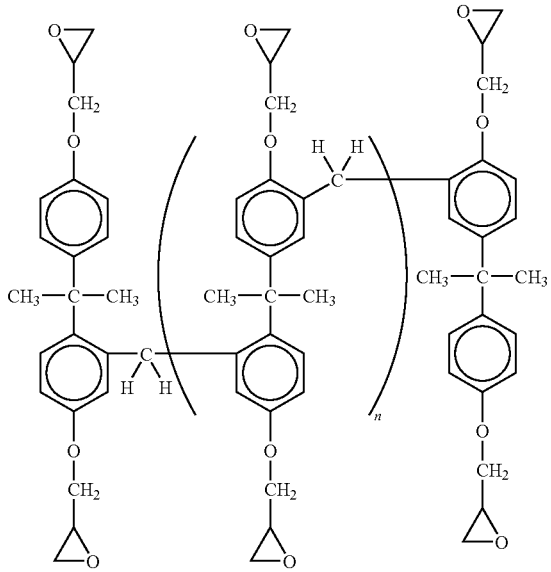

wherein n is an integer from about 1 to about 20, and preferably, 1 to 10.

The prepolymer including an alicyclic backbone and a glycidyl ether functional group in a monomer repeating unit may be a compound represented by Formula 7 below, and may be additional products of 1,2-epoxy-4(2-oxiranyl)-cyclohexane of 2,2-bis(hydroxy methyl)-1-butanol (EHPH-3150).

Formula 7

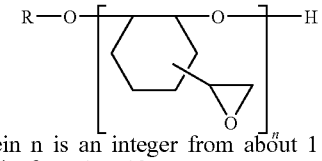

wherein n is an integer from about 1 to about 20, and preferably, from 1 to 10.

The prepolymer including a bisphenol-F backbone and a glycidyl ether functional group in a monomer repeating unit may be a compound represented by Formula 8 below.

Formula 8

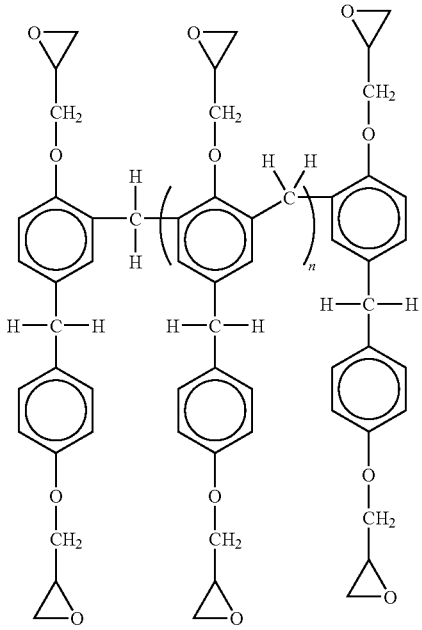

wherein n is an integer from about 1 to about 20, and preferably, from 1 to 10.

The prepolymer including a bisphenol-A backbone and an oxytein functional group in a monomer repeating unit may be a compound represented by Formula 9 below.

Formula 9

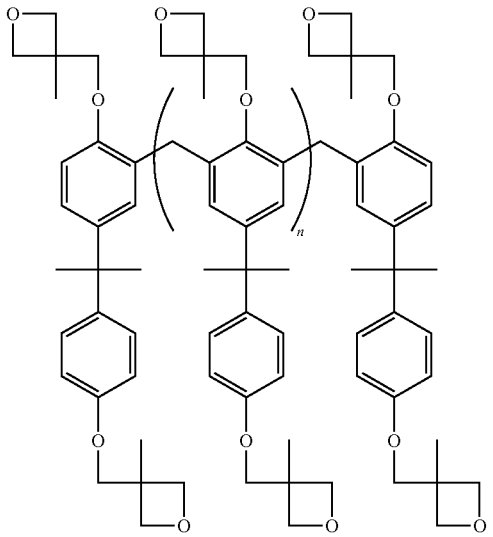

wherein n is an integer from about 1 to about 20, and preferably, from 1 to 10.

The prepolymer may include at least one of the compounds represented by Formulas 1 to 9.

The cationic photoinitiator contained in the first and second negative photoresist compositions may be compound generating ions or free radicals that initiate polymerization by being exposed to light. Examples of the cationic photoinitiator are an aromatic halonium salt or sulfonium salt of elements from Groups VA and VI. The cationic photoinitiator may be UVI-6974, or the like, manufactured by Union Carbide Corporation, and SP-172, or the like, manufactured by Asahi Denka Co., Ltd.

Examples of the aromatic sulfonium salt are triphenylsulfonium tetrafluoroborate, triphenylsulfonium hexafluoroantimonate (UVI-6974), phenylmethylbenzylsulfonium hexafluoroantimonate, phenylmethylbenzylsulfonium hexafluorophosphate, triphenylsulfonium hexafluorophosphate, methyl diphenylsulfonium tetrafluoroborate, and dimethyl phenylsulfonium hexafluorophosphate.

The aromatic halonium salt may be an aromatic iodonium salt. Examples of the aromatic iodonium salt are diphenyliodonium tetrafluoroborate, diphenyliodonium hexafluoroantimonate, and butylphenyliodonium hexafluoroantimonate (SP-172), but are not limited thereto.

The amount of the cationic photoinitiator may be about 1 to 10 parts by weight, and preferably, about 1.5 to 5 parts by weight based on 100 parts by weight of the prepolymer. When the amount of the cationic photoinitiator is less than 1 part by weight, a cross-linking reaction may not sufficiently occur. On the other hand, when the amount of the cationic photoinitiator is greater than 10 parts by weight, photo energy requirements may be increased, and thus, the cross-linking rate may be reduced.

The solvent used in the first and second negative photoresist compositions may include at least one selected from the group consisting of gamma-butyrolactone, propylene glycol methyl ethyl acetate, tetrahydrofuran, methyl ethyl ketone, methyl isobutyl ketone, cyclopentanone, and xylene.

The amount of the solvent may be about 30 to 300 parts by weight, and preferably, about 50 to 200 parts by weight based on 100 parts by weight of the prepolymer. When the amount of the solvent is less than 30 parts by weight, viscosity of the produced polymer may be so high that workability may be decreased. On the other hand, when the amount of the solvent is greater than 300 parts by weight, viscosity of the produced polymer is so low that patterns may not be formed.

The plasticizer contained in the first and second negative photoresist compositions may reduce cracks generated in a nozzle layer after developing nozzles and removing a sacrificial layer in the formation of the nozzles. Quality of the image may not degrade due to Y spacing. The amount of decline of an overall slope of a nozzle may be reduced since the plasticizer has a high boiling point, and is added to the cross-linked polymers, which lubricates and reduces stress on the nozzle layer. The use of the plasticizer may simplify the manufacturing process by omitting an additional baking process.

Phthalic acid, trimellitic acid, or phosphite may be used for the plasticizer. Examples of the phthalic acid plasticizer are dioctyl phthalate (DOP) and diglycidyl hexahydro phthalate (DGHP), but are not limited thereto. The trimellitic acid plasticizer may be triethylhexyl trimellitate, and the phosphite plasticizer may be tricresyl phosphate. These compounds may be used alone or in a combination of at least two.

The amount of the plasticizer may be about 1 to about 15 parts by weight, and preferably, about 5 to about 10 parts by weight based on 100 parts by weight of the prepolymer. When the amount of the plasticizer is less than 1 part by weight, the effects of the plasticizer are negligible. On the other hand, when the amount of the plasticizer is greater than 15 parts by weight, a cross-linking density of the prepolymer may be decreased.

The first and second negative photoresist compositions may further include a photo intensifier, a filler, a viscosity modifier, a wetting agent, and a photostabilizer, as additives. The amount of each of the additives may be about 0.1 to about 20 parts by weight based on 100 parts by weight of the prepolymer.

The photo intensifier absorbs energy from light and facilitates energy transmission to another compound to form a radical or an ionic photoinitiator. The photo intensifier expands the wavelength range of energy effective for exposure. The photo intensifier may be an aromatic chromophore that absorbs light. In addition, the photo intensifier may induce the formation of radicals or ionic photo initiators.

Hereinafter, the method of manufacturing an inkjet printhead will be described. FIGS. 3 to 12 are cross-sectional views showing a method of manufacturing the inkjet printhead according to an embodiment of the disclosure.

Figure 3:
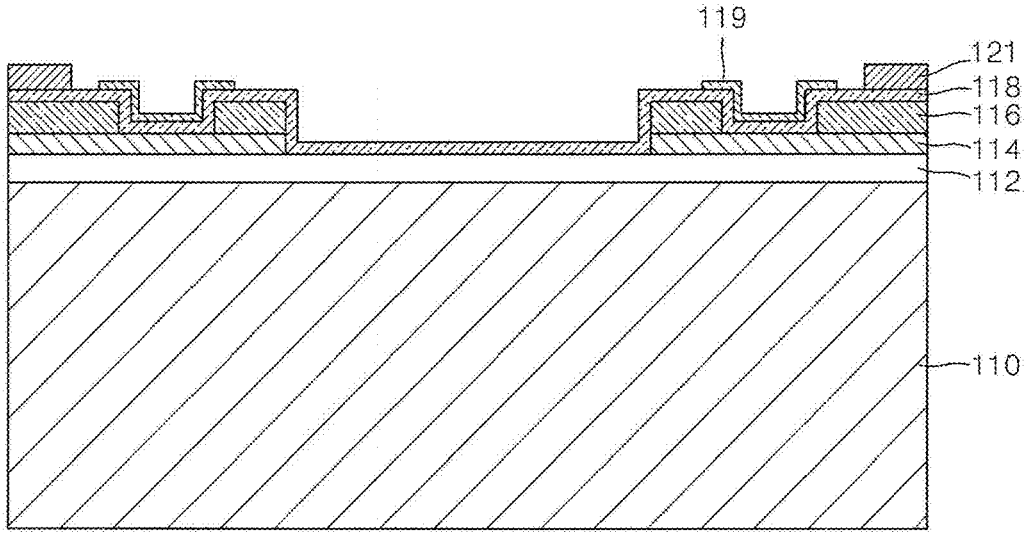
FIGS. 3 to 12 are cross-sectional views taken along line II-II' of FIG. 1, that describe a method of manufacturing an inkjet printhead, according to an embodiment of the disclosure. In particular, those figures show the following.

Referring to FIG. 3, a substrate 110 is prepared, and an insulating layer 112 is formed on the substrate 110. The substrate 110 may be a silicon substrate. The insulating layer 112 is formed for insulation between the substrate 110 and heaters 114 and may be formed of a silicon oxide. Then, the heaters 114 for generating ink bubbles by heating ink, are formed on the insulating layer 112. The heaters 114 may be formed by depositing a heating resistor material, such as a tantalum-aluminum alloy, a tantalum nitride, a titanium nitride, or a tungsten silicide, on the insulating layer 112 and patterning the heating resistor. A plurality of electrodes 116, for supplying current to the heaters 114, are formed on the heaters 114. The electrodes 116 may be formed by depositing a metal having excellent electrical conductivity, such as Al, an Al alloy, Au, or Ag, on the heaters 114, and then patterning the metal.

A passivation layer 118 may be formed on the insulating layer 112 so as to cover the heaters 114 and the electrodes 116. The passivation layer 118 is formed to prevent or reduce oxidization and corrosion of the heaters 114 and the electrodes 116 caused by ink. This layer may be formed of a silicon nitride or a silicon oxide.

Also, a glue layer 121 including the photoresist may be formed on the passivation layer 118. This increases an adhesion force between a chamber material layer 120' (FIG. 4) and the passivation layer 118.

An anti-cavitation layer 119 may further be formed on the passivation layer 118 positioned on the heaters 114, so as to protect its corresponding heater 114 from a cavitation force generated when bubbles "pop". The layer 119 may be formed of tantalum (Ta).

Figure 4:
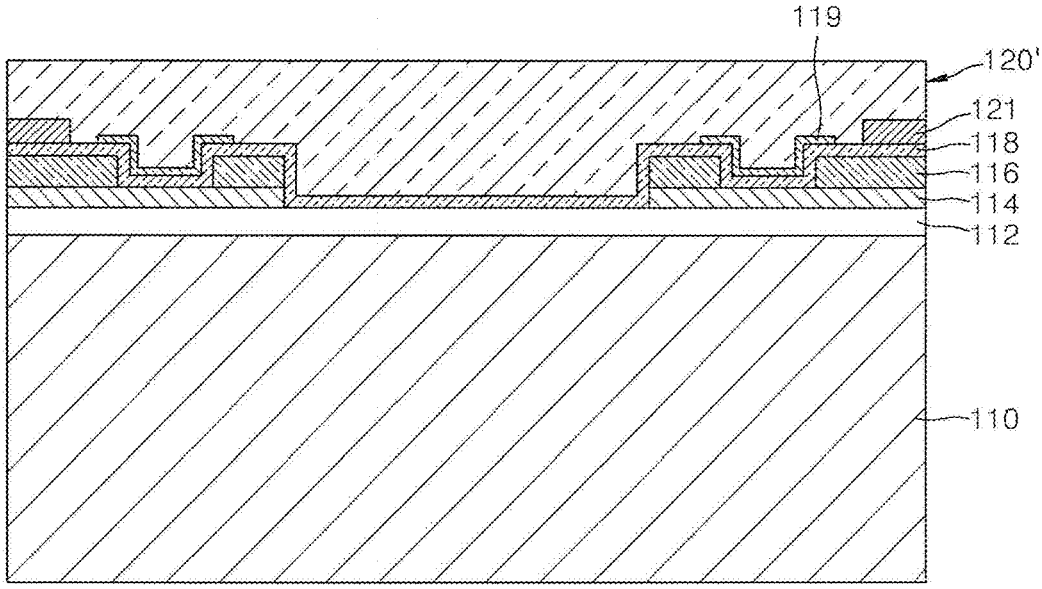

Referring to FIG. 4, the chamber material layer 120' is formed on the passivation layer 118. As shown in FIG. 4, the chamber material layer 120' may be placed in contact with passivation layer 118, glue layer 121 and anti-cavitation layer 119. The chamber material layer 120' includes a first negative photoresist composition, etc. The chamber material layer 120' may be formed by laminating a dry film including photoresist, a photo acid generator (PAG), etc., on the passivation layer 118.

The photoresist used to form the chamber material layer 120' may be a negative type photosensitive polymer. The photoresist may be an alkali-soluble resin. Examples of the alkali-soluble resin are ANR manufactured by AZ Electronic Materials, SPS manufactured by Shinetsu Chemical Co., Ltd., and WPR manufactured by JSR Corporation, but are not limited thereto.

The chamber material layer 120' is subjected to a light exposure process and a post exposure bake (PEB) process. In particular, the chamber material layer 120' is exposed to light using a photomask (not shown) having an ink chamber pattern and a restrictor pattern. In this regard, if the chamber material layer 120' includes a negative type photosensitive polymer, acid is generated in exposed regions 120'*a* (FIGS. 5 and 6) of the chamber material layer 120' by a photoacid generator; for example, PAG. Then, the exposed regions 120'*a* are subjected to the PEB process. The PEB process may be conducted at a temperature ranging from about 90 to 120° C. for about 3 to 5 minutes. With the PEB process, a cross-linking reaction occurs in the exposed regions 120'*a* of the chamber material layer 120' to form a cross-linked first negative photoresist composition.

Figure 5:
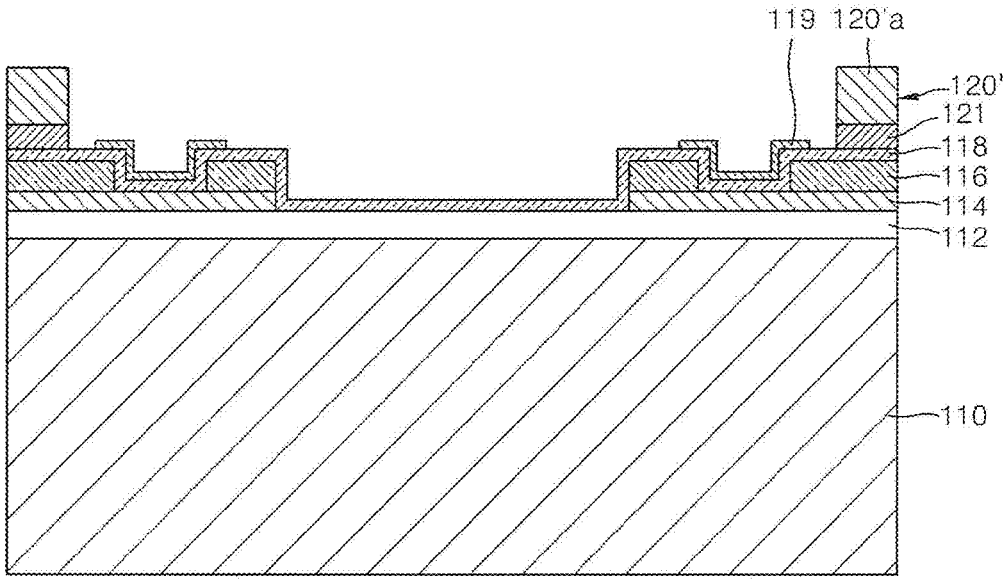

Referring to FIG. 5, the chamber material layer 120' is subjected to a development process, after the light exposure process and the PEB process, to form a chamber layer 120 (FIG. 2). The unexposed regions of the chamber material layer 120' are removed by a developing solution during the development process. In this regard, since the first negative photoresist composition of the exposed regions 120'*a* of the chamber material layer 120' have a cross-linked structure formed by the PEB process, the exposed regions 120'*a* of the chamber material layer 120' are not removed by the development process but form the chamber layer 120.

Figure 6:
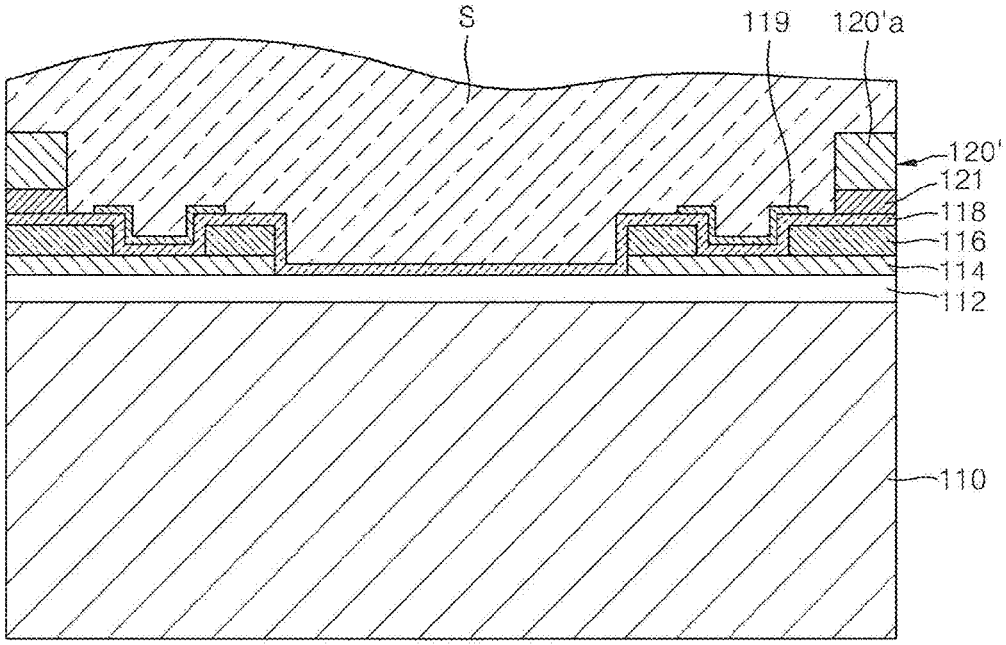

Referring to FIG. 6, a sacrificial layer S is formed on the chamber material layer 120' which was subjected to the light exposure process and the PEB process, and the height of the sacrificial layer S is greater than that of the chamber layer 120. As shown in FIG. 6, sacrificial layer S may be placed in contact with chamber material layer 120', passivation layer 118, and anti-cavitation 119. The sacrificial layer S may be formed by coating positive photoresist or a non-photosensitive soluble polymer to a predetermined thickness on the substrate 110 using a spin coating process. Here, the positive photoresist may be an imide-based positive photoresist. If the imide-based positive photoresist is used for the sacrificial layer S, the sacrificial layer S is not affected by the solvent and nitrogen gas is not generated even upon exposure. For this, the imide-based positive photoresist should be subjected to hard baking at about 140° C. Also, the sacrificial layer S may be formed by coating liquid non-photosensitive soluble polymer to a predetermined thickness on the substrate 110 using a spin coating process and baking the non-photosensitive soluble polymer. Here, the non-photosensitive soluble polymer may include at least one of a phenol resin, a polyurethane resin, an epoxy resin, a polyimide resin, an acrylic resin, a polyamide resin, an urea resin, a melamine resin, and a silicon resin.

Figure 7:
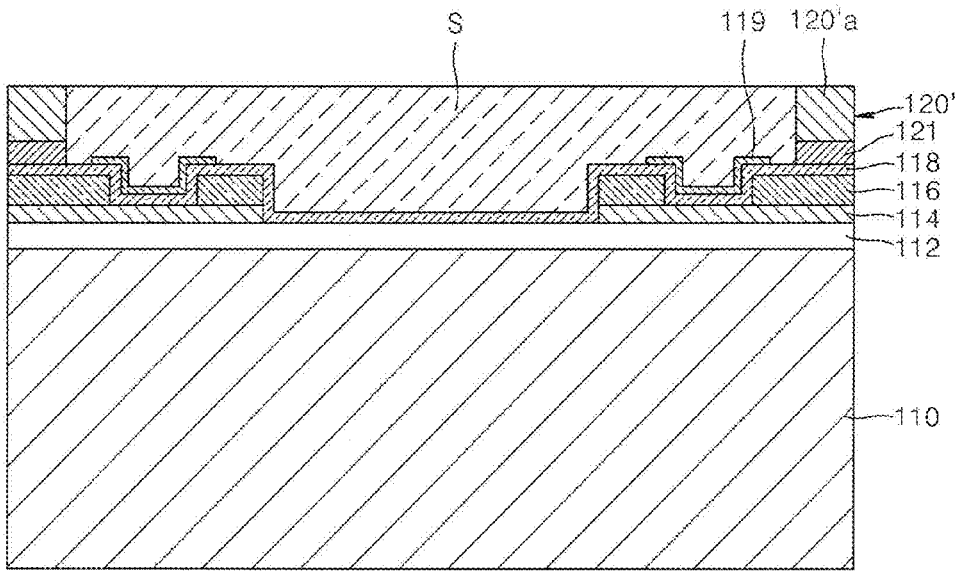

Then, the chamber layer 120 and the sacrificial layer S are planarized using a chemical mechanical polishing (CMP) process as shown in FIG. 7. The top surfaces of the sacrificial layer S and the chamber layer 120 are polished using the CMP process to a desired height of the ink passage so that the top surfaces of the chamber layer 120 and the sacrificial layer S are formed at substantially the same height.

Figure 8:
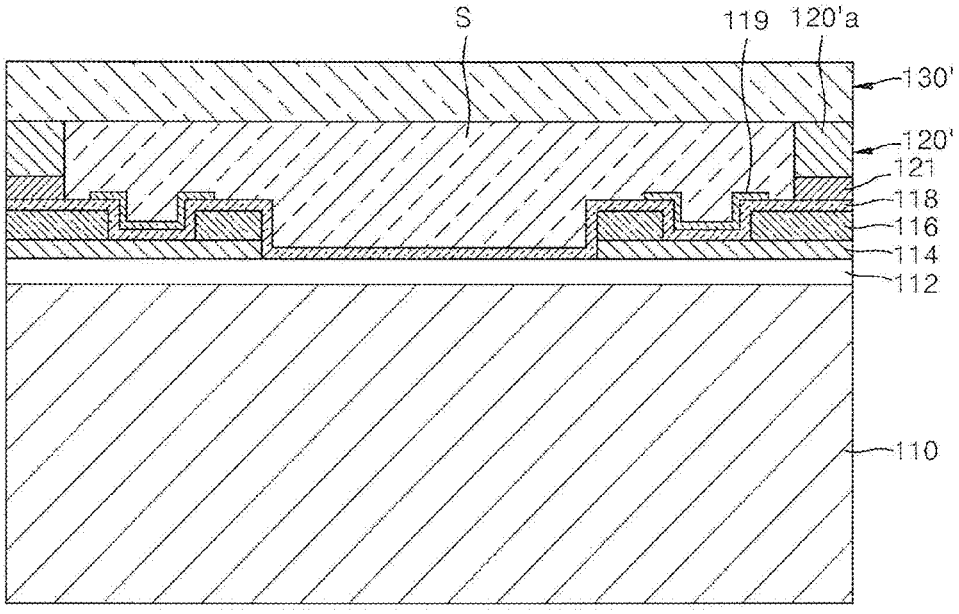

Referring to FIG. 8, a nozzle material layer 130' is formed on the chamber layer 120 and the sacrificial layer S. As shown in FIG. 8, nozzle material layer 130' may be in contact with sacrificial layer S and exposed region 120'*a*. The nozzle material layer 130' includes a second negative photoresist composition, etc. The nozzle material layer 130' may be formed by laminating a dry film including photoresist, a photo acid generator (PAG), etc., on the chamber material layer 120'. The photoresist contained in the nozzle material layer 130' may be a negative type photosensitive polymer.

Figure 9:
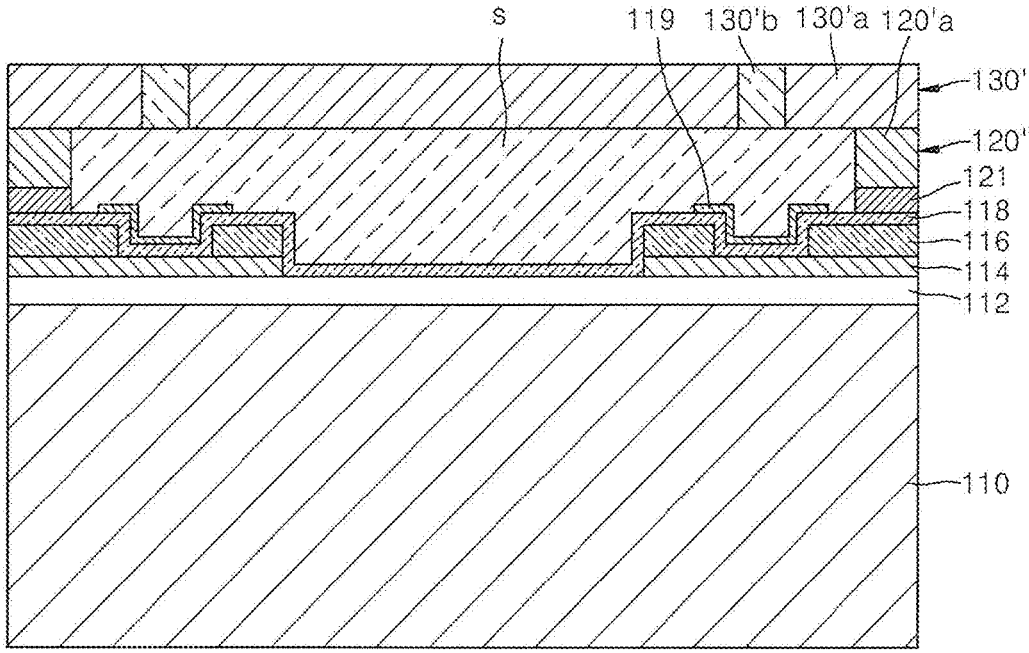

Referring to FIG. 9, the nozzle material layer 130' is subjected to a light exposure process. In particular, the nozzle material layer 130' is exposed to light using a photomask (not shown) having a nozzle pattern. In this regard, when the second negative photoresist composition is exposed to light, acid is generated in exposed regions 130'*a* of the nozzle material layer 130' by PAG. In FIG. 9, reference numeral 130'*b* indicates unexposed regions of the nozzle material layer 130'.

Figure 10:
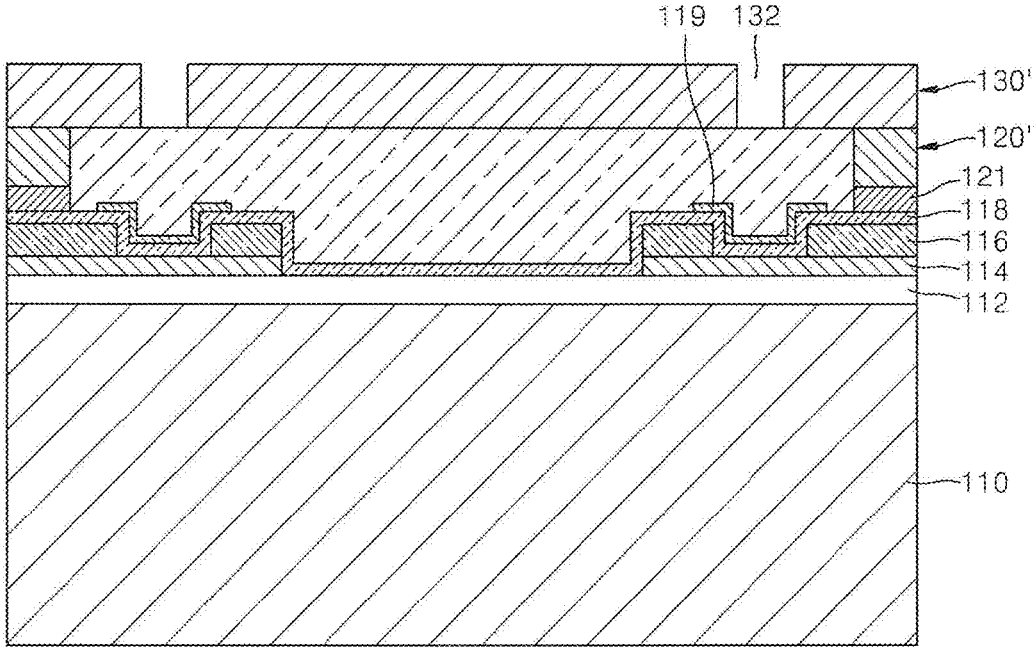

Referring to FIG. 10, the nozzle material layer 130' exposed to light is subjected to a PEB process and a development process to form a nozzle layer 130 (not shown in FIG. 10). In particular, the nozzle material layer 130' is subjected to a PEB process. The PEB process may be conducted at a temperature ranging from about 90 to 120° C. for about 3 to 5 minutes, but the conditions for the PEB process are not limited thereto. The second negative photoresist composition is cross-linked in the exposed regions 130'*a* of the nozzle material layer 130' by the PEB process. Then, the nozzle material layer 130' is subjected to the development process. The unexposed regions 130'*b* of the nozzle material layer 130' are removed with a predetermined developing solution by the development process to form a plurality of nozzles 132. In this regard, since the second negative photoresist composition contained in the exposed regions 130'*a* of the nozzle material layer 130' has a cross-linked structure due to the PEB process, the exposed regions 130'*a* of the nozzle material layer 130' are not removed by the development process, and thus, form the nozzle layer 130.

Figure 11:
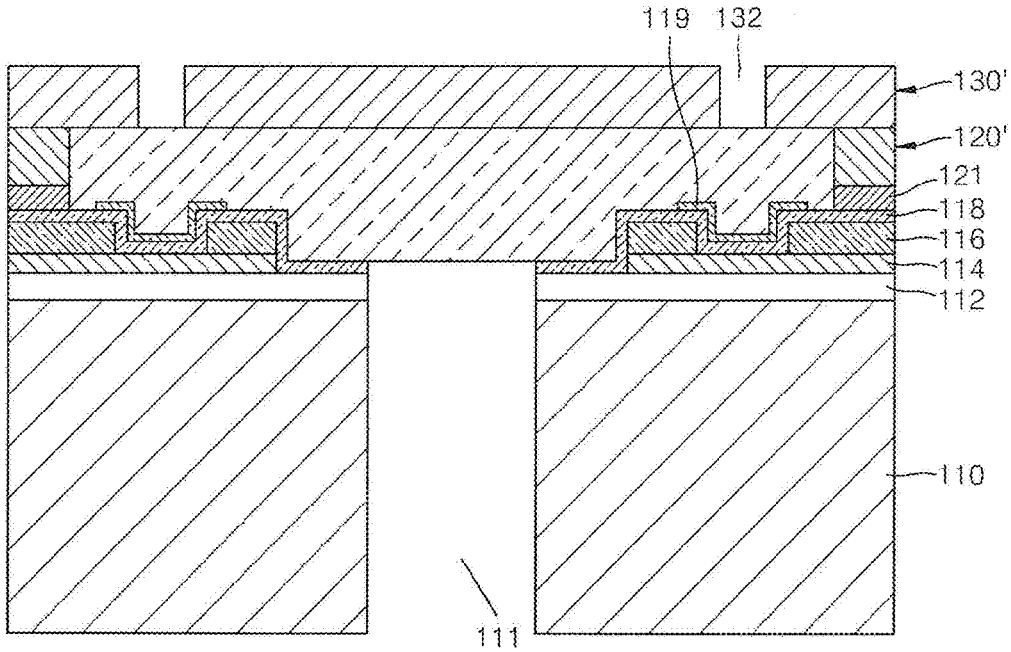
Figure 12:
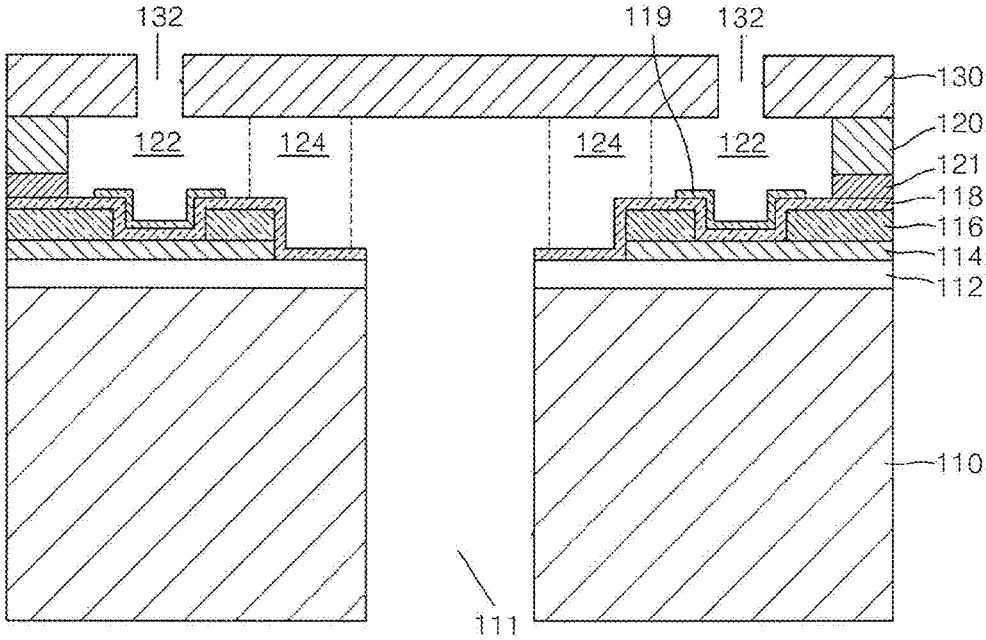

Referring to FIG. 11, an ink feed passage 111 for supplying ink is formed through the substrate 110. The ink feed hole 111 may be formed by sequentially processing the passivation layer 118, the insulating layer 112, and the substrate 110. In this regard, the ink feed passage 111 may be prepared by dry etching, wet etching, laser processing, or by various other processes. In the current embodiment, the ink feed hole 111 is formed so as to penetrate the substrate 110 from the bottom surface to the top surface of the substrate 110. The inkjet printhead shown in FIG. 12 is manufactured by the above-described processes.

PREPARATION EXAMPLE 1

Preparation of Photoresist Composition 30 parts by weight of a novolac resin in which the weight ratio of m-cresol:p-cresol is 4:6, 3 parts by weight of TME-triazine (Samwha Chemical Co., Ltd.), 5 parts by weight of hexamethylol melamine, and 100 parts by weight of PGMEA were added into a jar and uniformly mixed to prepare a photoresist composition.

PREPARATION EXAMPLE 2

Preparation of Negative Photoresist Composition 30 g of PGMEA (Samchun Chemical Co., Ltd.), 2 g of diglycidyl hexahydro phthalate (Sigma-Aldrich Corporation), and 2 g of SP-172 (Asahi Denka Korea Chemical Co., Ltd.) were added into a jar to prepare a resist solution. Then, 40 g of EPON SU-8 (Hexion Speciality Co.) was added into the jar, and the solution was mixed in an impeller for about 24 hours before being used to prepare a negative photoresist composition Example 1 of a Method of Manufacturing as Inkjet Printhead An insulating layer 112 having a thickness of about 2 μm and formed of a silicon oxide, a tantalum nitride heater pattern 114 having a thickness of about 500 Å, an electrode pattern having a thickness of about 500 Å and formed of AlSiCu alloy in which the amount of Si and Cu is respectively 1% by weight or less, a silicon nitride passivation layer 118 having a thickness of about 3000 Å, and an anti-cavitation layer 119 having a thickness of about 3000 Å and formed of tantalum, were sequentially formed on a 6-inch silicon wafer 110 using a conventional sputtering process and photolithography process (FIG. 3).

Then the silicon wafer 110 on which the layers were formed was treated at 200° C. for 10 minutes to remove moisture, and treated with hexamethyldisliazane (HMD) as an adhesion promoter. Then, the photoresist composition prepared in Preparation Example 1 was spin coated on the silicon wafer 110 at 1100 rpm/40 sec, and soft-baked at 110° C. for 3 minutes. Then, a light exposure process was conducted with UV light of about 13 mW/cm$^2$ for 4.5 seconds using a negative photomask. A post-exposure bake process was conducted at 110° C. for 3 minutes to form a pattern. The resultant was developed using a 300 MIF developer for 1.5 minutes, rinsed using ultra pure water, and dried. Then, a post-bake process was conducted at 90° C. for 5 minutes and at 180° C. for 10 minutes, and the resultant was gradually cooled to form a glue layer 121 having a thickness of about 2 μm on the passivation layer 118 (FIG. 3).

Then, the negative photoresist composition prepared in Preparation Example 2 was spin coated on the glue layer 121 at 2000 rpm for 40 seconds, and baked at 95° C. for 7 minutes to form a first negative photoresist layer having a thickness of about 10 μm (FIG. 4). Then, as shown in FIG. 5, the first negative photoresist layer was exposed to i-line UV light of about 130 mJ/cm$^2$ using a first photomask having predetermined ink chamber and restrictor patterns. The wafer was baked at 95° C. for 3 minutes, dipped in a PGMEA developer for 1 minutes, and rinsed using isopropanol for 20 seconds. Thus, a chamber layer 120 was prepared (FIG. 6).

Then, as shown in FIG. 7, an imide-based positive photoresist (Model No.: PW-1270, manufactured by TORAY Industries, Inc.) was spin coated on the overall surface of the wafer, on which the pattern of the chamber layer 120 is formed, at 1000 rpm for 40 seconds and baked at about 140° C. for 10 minutes to form a sacrificial layer S. The thickness of the sacrificial layer S was controlled so that the thickness of the sacrificial layer S formed on the pattern of the chamber layer 120 is about 5 μm.

Then, the top surfaces of the pattern of the chamber layer 120 and the sacrificial layer S were planarized using a chemical mechanical polishing (CMP) process as shown in FIG. 8. For this, the wafer was supplied onto a polishing pad (Model No. JSR FP 8000, manufactured by JSR Corporation) of a polishing plate such that the sacrificial layer S faced the polishing pad. Then, the wafer was pressed onto the polishing pad under a pressure of 10-15 kPa with a backing pad, by a press head. While polishing slurries (FUJIMI Corporation, POLIPLA 103) were supplied onto the polishing pad, the press head was rotated with respect to the polishing plate. At this time, the rotation speed of each of the press head and the polishing pad was 40 rpm. The backing pad was made of a material having a Shore D hardness of 30 to 70. The sacrificial layer S was planarized at an etch rate of 5 to 7 μm until the top surface of the pattern of the chamber layer 120 was removed by a thickness of about 1 μm.

A pattern of the nozzle layer 130 was formed on the silicon wafer 110, on which the pattern of the chamber layer 120 and the sacrificial layer S were formed, in the same conditions as in the formation of the pattern of the chamber layer 120 using the negative photoresist composition prepared in Preparation Example 2 and a photomask (FIGS. 8, 9, and 10).

Then, an etch mask for forming the ink feed hole 111 was formed on the bottom surface of the silicon wafer 110 using conventional photolithography, as shown in FIG. 11. Then, the bottom surface of the silicon wafer 110 exposed through the etch mask was etched using a plasma etching process to form the ink feed hole 111, and the etch mask was removed. At this time, an etching power of a plasma etching apparatus was adjusted to 2000 Watt, an etching gas was a mixture gas of $SF_6$ and $O_2$ (mixture ratio: 10:1 by volume), and an etch rate was 3.7 μm/min.

Finally, the wafer was dipped in a methyl lactate solvent for 2 hours to remove the sacrificial layer S, thereby forming ink chambers 122 and restrictors 124 surrounded by the chamber layer 120 in the space obtained by the removal of the sacrificial layer S. Thus, the inkjet printhead having a structure shown in FIG. 12 was completed.

According to a scanning electron microscope (SEM) image of an inkjet printhead, boundaries between a glue layer and a chamber layer were not observed. Furthermore, when the inkjet printhead was immersed in ink at 60° C. for 2 weeks in order to evaluate durability against ink, delamination between the glue layer and the chamber layer, and between a substrate and the glue layer, was not observed. Therefore, the material used to form the glue layer adheres well to the substrate and the chamber layer. It is also chemically durable against ink.

While the disclosure has been particularly shown and described with reference to exemplary embodiments thereof, it will be understood by those of ordinary skill in the art that various changes in form and details may be made without departing from the spirit and scope of the disclosure as defined by the following claims.

What is claimed is:

1. An inkjet printhead comprising:

at least one substrate having at least one ink feed passage;

at least one chamber layer above the substrate, the chamber layer comprising at least one ink chamber in communication with the ink feed passage, the ink chamber configured to house ink from the ink feed hole;

at least one nozzle layer above the chamber layer, the nozzle layer comprising at least one nozzle in communication with the ink chamber, the nozzle configured to eject ink; and at least one glue layer interposed between the substrate and the chamber layer, wherein the glue layer comprises a cross-linked photoresist composition comprising photoresist.

2. The inkjet printhead of claim 1, wherein the photoresist composition comprises about 1 to about 20 parts by weight of a cross-linking agent, about 0.5 to about 10 parts by weight of a photoacid generator, and about 10 to about 200 parts by weight of a solvent, all based on about 1 to about 70 parts by weight of the photoresist.

3. The inkjet printhead of claim 1, further comprising:

at least one insulating layer formed above the substrate;

at least one heater and at least one electrode, the heater and electrode formed above the insulating layer; and at least one passivation layer substantially covering the heater and electrode.

4. The inkjet printhead of claim 3, further comprising at least one anti-cavitation layer above the passivation layer.

5. The inkjet printhead of claim 1, wherein the photoresist is selected from the group consisting of a phenol-based resin, an acryl-based resin, and a mixture of the phenol-based resin and the acryl-based resin.

6. The inkjet printhead of claim 5, wherein the phenol-based resin is prepared by a reaction between a phenol-based compound and an aldehyde-based compound or between a phenol-based compound and a ketone-based compound, wherein either reaction is carried out in the presence of an acidic catalyst.

7. The inkjet printhead of claim 5, wherein the phenol-based resin is selected from the group consisting of m-cresol, p-cresol and a mixture of m-cresol and p-cresol.

8. The inkjet printhead of claim 5, wherein the acryl-based resin is at least one selected from the group consisting of glycidyl acrylate, methyl(metha)acrylate, ethyl(metha)acrylate, methacrylic acid, styrene, benzylacrylate and acrylic acid.

9. The inkjet printhead of claim 5, wherein the acryl-based resin is glycidyl acrylate represented by the formula below:

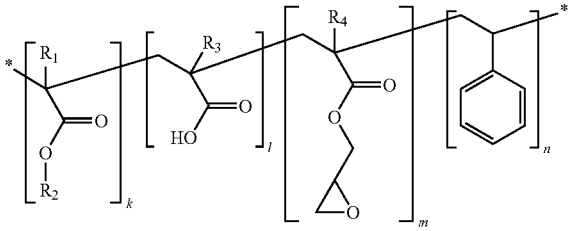

wherein $R_1$, $R_3$ and $R_4$ are each independently a methyl group or a hydrogen atom, $R_2$ is a phenyl group or a benzyl group, and k, l, m and n are each independently from about 0.01 to about 0.99, wherein the sum of k, l, m and n is about 1.

10. The inkjet printhead of claim 4, wherein the phenol-based resin and the acryl-based resin are alkali-soluble.

* * * * *